US005408058A

United States Patent [19]

Homik et al.

[11] Patent Number: 5,408,058

[45] Date of Patent: Apr. 18, 1995

[54] MOMENTARY ELECTRICAL SWITCH WITH MECHANICAL INTERLOCK

[75] Inventors: William J. Homik, Ephrata; Roger W. Sprague, York, both of Pa.

[73] Assignee: Ford New Holland, Inc., New Holland, Pa.

[21] Appl. No.: 166,732

[22] Filed: Dec. 15, 1993

[51] Int. Cl.[6] ..... H01H 9/20; H01H 3/00

[52] U.S. Cl. ..... 200/50 R; 200/17 R; 200/16 C

[58] Field of Search ..... 200/16 R–16 F, 200/318, 318.1, 318.2, 319–327, 5 R–5 EB, 50 R–50 C, 43.16, 43.18, 520–522

[56] References Cited

U.S. PATENT DOCUMENTS

| | | | |
|---|---|---|---|
| 448,044 | 3/1891 | Iske | 200/540 |
| 2,545,395 | 3/1951 | Tobin | 200/43.12 |
| 2,810,050 | 10/1957 | Johnson | 200/319 |
| 3,567,874 | 3/1971 | Strobel | 200/16 D |
| 3,585,620 | 6/1971 | Durand et al. | 340/540 |
| 3,696,222 | 10/1972 | Langan et al. | 200/16 R |
| 3,729,607 | 4/1974 | Ellenberger | 200/314 |
| 4,182,943 | 1/1980 | Butterworth | 200/318.2 |
| 4,431,881 | 2/1984 | Sauer et al. | 200/318.2 |
| 4,733,035 | 3/1988 | Ohashi | 200/43.18 X |
| 4,902,865 | 2/1990 | Muller et al. | 200/318.2 X |

*Primary Examiner*—J. R. Scott

*Attorney, Agent, or Firm*—Griffin, Butler, Whisenhunt & Kurtossy

[57] ABSTRACT

A momentary electrical switch includes fixed contacts fixed relative to a switch housing and slidable contacts located within the housing. A contact operating mechanism includes a manual control knob, slide element and a support attached to the slide for supporting the slidable contacts, the contact operating mechanism being movable axially in a first direction against a compression spring when the knob is pulled. An interlock element extends beyond the periphery of the slide to engage the casing to prevent movement of the contact operating mechanism when the knob is pulled. A spring biased interlock release stem is moved axially in an opposing second direction by pressing on a pushbutton to disengage the interlock element from the casing. The movable switch contacts are moved in the first direction relative to the fixed contacts only by concurrently pressing in one direction on the pushbutton while pulling on the knob in the opposite direction. When the knob is released the compression spring returns the contact operating mechanism and the movable contacts to their neutral position. When the pushbutton is released the interlock element is again extended beyond the periphery of the slide. The switch has three positions and two sets of fixed contacts. In the neutral position one slidable contact bridges a first set of fixed contacts. When the knob is pulled in the first direction while releasing the interlock element, the slidable contacts bridge both sets of fixed contacts. In the second direction, neither set of fixed contacts is bridged.

18 Claims, 5 Drawing Sheets

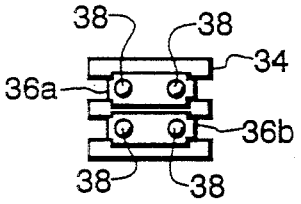
Fig.3
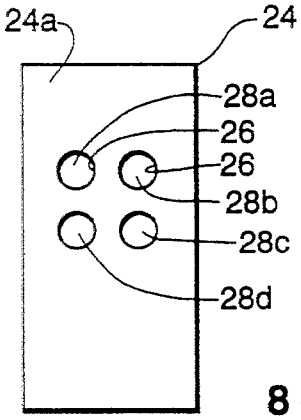
Fig. 4
Fig. 5
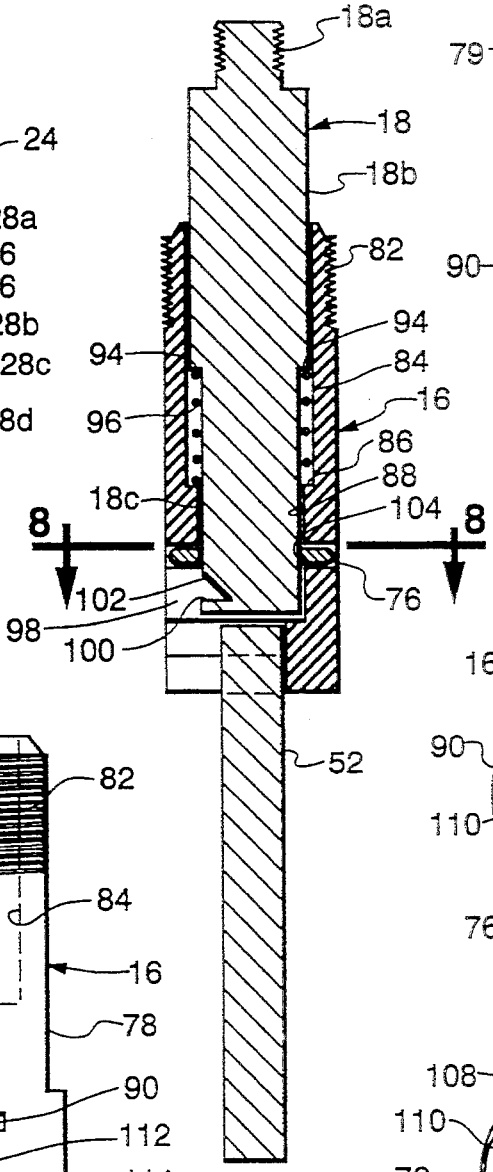
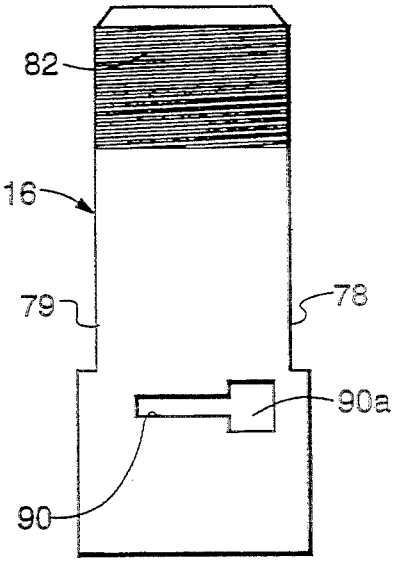
Fig. 7
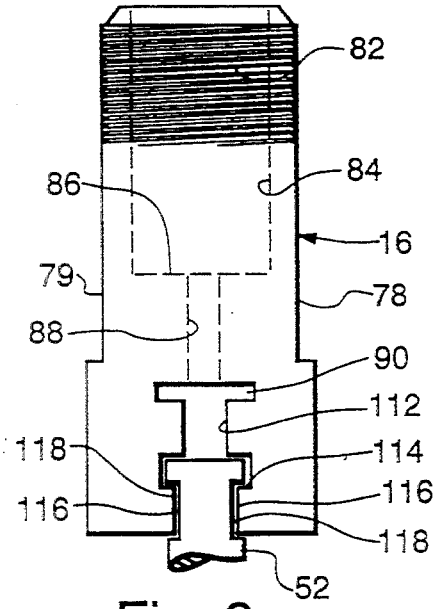
Fig. 6
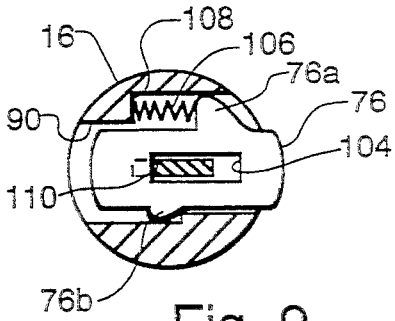
Fig. 9
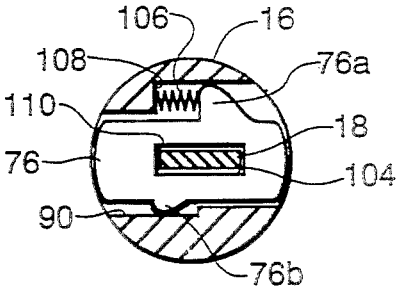
Fig. 8

MOMENTARY ELECTRICAL SWITCH WITH MECHANICAL INTERLOCK

FIELD OF THE INVENTION

The present invention relates to a momentary electrical switch and more particularly to a manually operated momentary switch having a mechanical interlock which prevents turning the switch on unless the operator concurrently operates an interlock release mechanism and the mechanism which moves the switch contacts.

BACKGROUND OF THE INVENTION

On agricultural tractors and off-road machinery it has been conventional to provide a manually actuated switch for controlling energization of electrically controlled devices such as, for example, a power take off system. Conventionally, such switches have been multistable, that is, they remain on when switched to the on position and remain off when switched to the off position. A switch of this type has a disadvantage in that if there should be a loss of power, it will cause re-energization of the controlled device if the switch is in the on position when power is restored.

A further disadvantage occurs when multi-stable switches are used in a computer-controlled system where the computer senses the change of state rather than the state of the switch. In this case the operator must remember to reset the switch, otherwise its physical position will not correspond to the state recognized by the computer.

A problem with both multi-stable switches and momentary switches of the prior art concerns safety. An operator may inadvertently actuate the switch and, depending on the device being controlled, this may create a hazardous condition.

SUMMARY OF THE INVENTION

An object of the present invention is to provide a momentary switch which avoids the disadvantages of the prior art.

An object of the invention is to provide a momentary switch with a mechanical interlock for preventing operation of the switch unless the user concurrently releases the interlock while actuating the switch.

A further object of the invention is to provide a momentary switch with a mechanical interlock which prevents actuation of the switch unless the user concurrently applies a force in one direction to release the interlock and applies a force in the opposite direction to actuate the switch.

Another object of the invention is to provide a momentary switch as described above and having a housing for enclosing fixed and slidable switch contacts, a casing affixed to the housing, and a slide element movable along an axis in the casing, the slide element being connected to a contact support for moving the slidable contacts, the slide element cooperating with an interlock element for preventing movement of the slide element along the axis in a first direction, and an interlock release mechanism for releasing the interlock element.

Still another object of the invention is to provide a momentary switch as described above and including a knob attached to the slide element for pulling the switch contacts in the first direction, the interlock release mechanism including a pushbutton located in an opening in the knob and a stem operated by pressing the pushbutton in a second direction opposite to the first direction to release the interlock.

Yet another object of the invention is to provide a momentary switch as described above having a neutral position to which it is moved by compression springs, and an actuated position and an off position to which it may be moved by a manually applied force, the switch having slidable contacts for selectively bridging two pairs of the fixed contacts as the switch is moved between the three positions, the arrangement being such that the two pairs of fixed contacts may be connected in a series circuit with an electrical element across a voltage to energize the element when the switch is moved to the actuated position and deenergize the element when the switch is moved to the off position.

Other objects of the invention and the method of making and using it will become obvious upon consideration of the following description and the accompanying drawings.

BRIEF DESCRIPTION OF DRAWINGS

FIG. 3 shows the movable switch contacts and contact slide block;

FIG. 4 shows an insulator plate with the fixed switch contacts extending through it;

FIG. 5 is a sectional view of the interlock slide and interlock operating mechanism;

FIG. 6 is a left side view of the interlock slide shown in FIG. 5;

FIG. 7 is a right side view of the interlock slide shown in FIG. 5;

FIG. 8 is a sectional view taken along the line 8—8 of FIG. 7, the interlock being shown in a non-interlocking position;

FIG. 9 is a sectional view taken in the plane 8—8 of FIG. 7 but showing the interlock in the interlocking position;

DESCRIPTION OF THE INVENTION

As used herein, "momentary" is used to define a switch in which the contacts return to a home or rest position as soon as the force which actuates the switch is terminated. In the following description, "vertical", "horizontal", "above", "below", "up" and "down" are used as words of description rather than words of limitation since it will be obvious from the following description that the switch may be mounted in various orientations.

Figure 1:
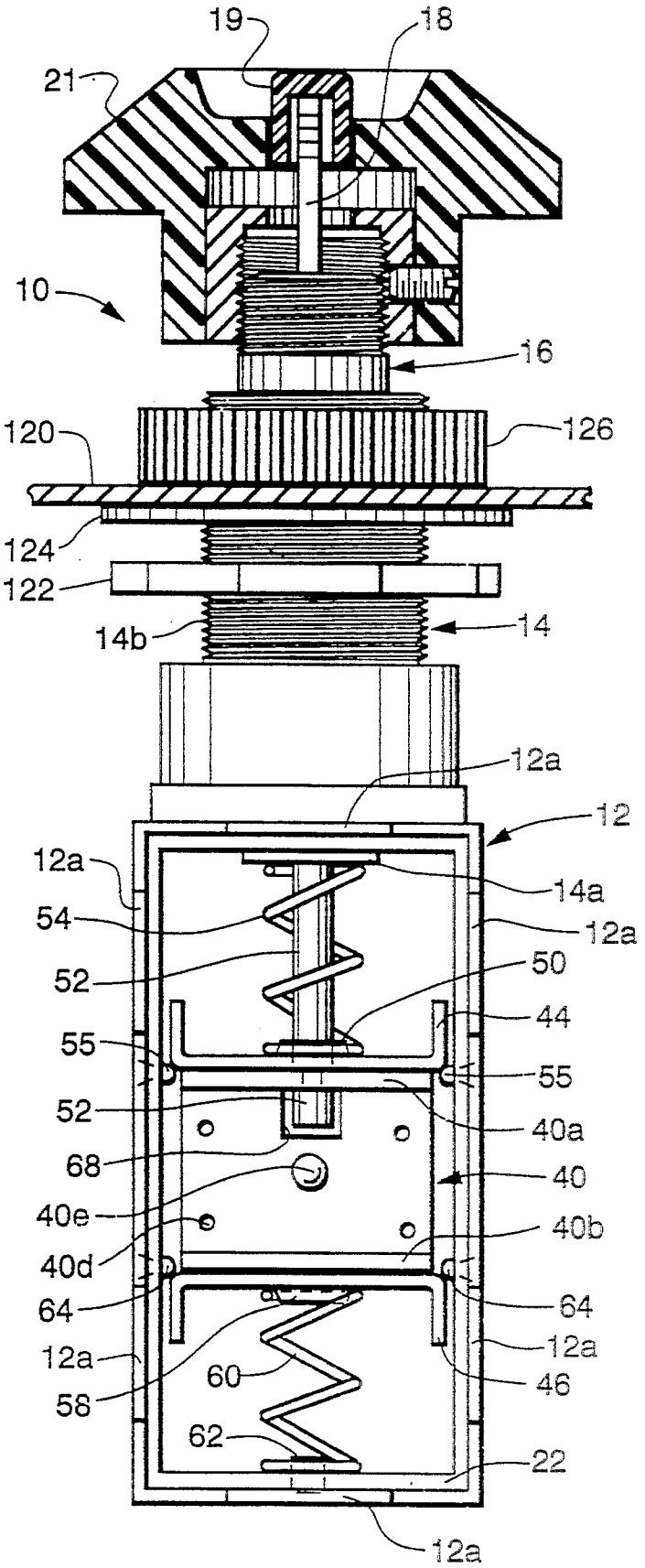
FIG. 1 is a front elevation view of a momentary switch with the front cover and switch contacts removed.
Figure 2:
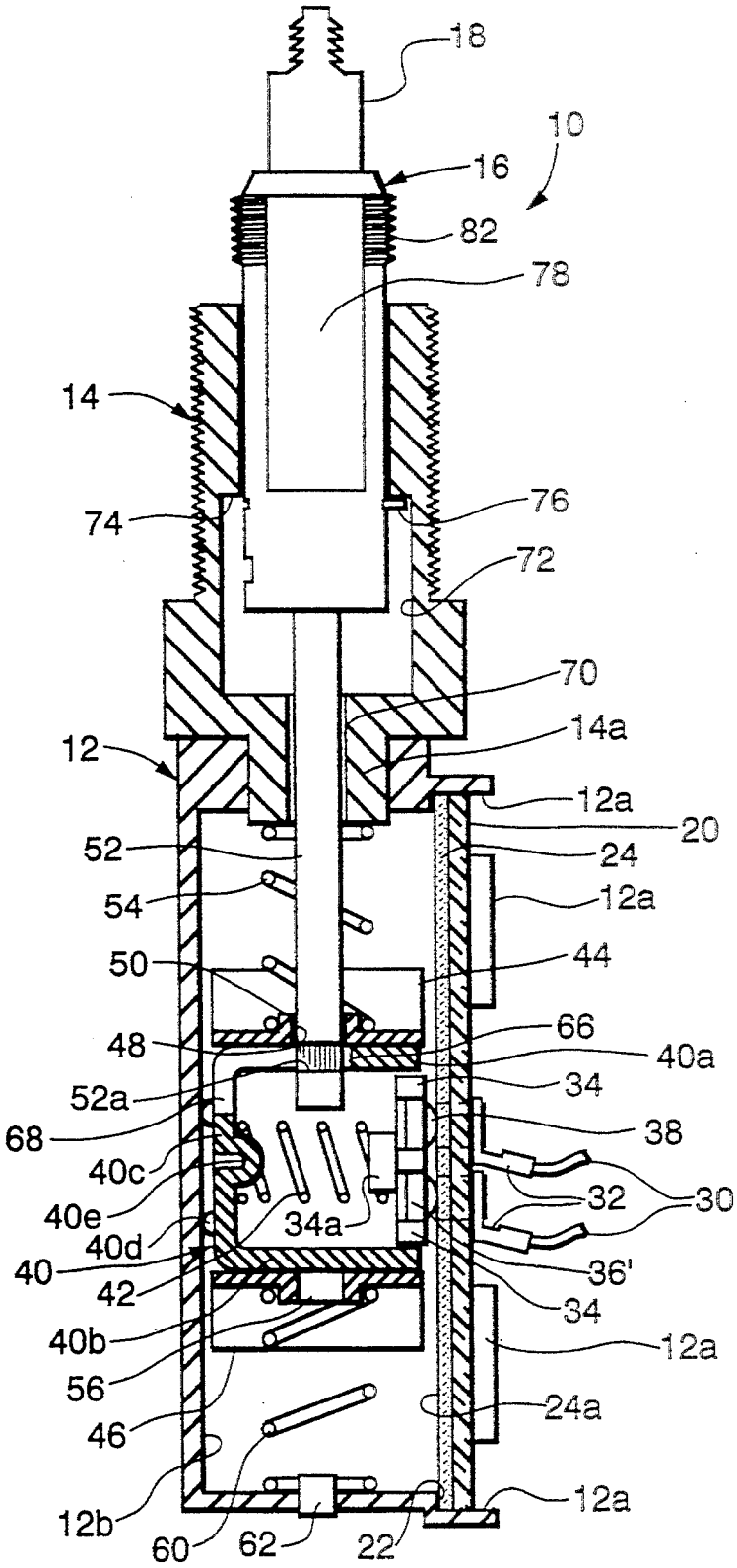
FIG. 2 is a part-sectional view of the switch taken generally along the axis of the switch, the interlock element, slide, and interlock release stem being shown in full elevation.

As illustrated in FIGS. 1 and 2, a preferred embodiment of a mechanically interlocked momentary electrical switch 10 comprises a contact housing 12, a casing 14, a slide element 16, an interlock release stem 18, an interlock release pushbutton 19 and a switch actuating knob 21.

The contact housing 12 is a generally rectangular box-like structure having a removable electrically insulating cover 20 (FIG. 2) which is normally clamped to the housing by a plurality of bendable tangs 12*a*. Housing 12 is shaped to have a peripheral ledge 22 on which a flat insulator 24 may rest. Insulator 24 is provided with a plurality of holes 26 (FIG. 4) and the cover is provided with four stationary electrical contacts 28*a*, 28*b*, 28*c*, 28*d* which extend through the holes and lie flush with interior surface 24*a* of the insulator. Four electrical leads 30, two of which are visible in FIG. 2, are individually connected to contacts 28*a*, 28*b* by connectors 32 which may be spade lugs or solder connections.

As shown in FIGS. 2 and 3, the switch is provided with a contact slide block 34. The block carries two metal contacts 36*a*, 36*b* each having two switch contact points 38 thereon. The ends of contacts 36*a*, 36*b* are bent over to clamp the edges of block 34 thereby holding the contacts on the slide block.

Figure 10A:
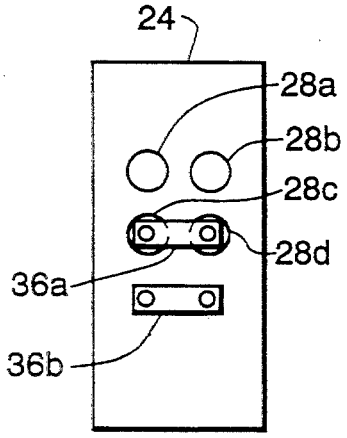
FIGS. 10A, 10B and 10C illustrate the positions of the movable contacts relative to the fixed contacts when the switch is in a neutral, an actuated and an off position, respectively.

As will be evident from the following description, the contacts 36*a*, 36*b* are slidable relative to fixed contacts 28*a*–28*d* and may be moved to any one of three positions relative thereto. When the switch is in a neutral position (illustrated in FIG. 2) a circuit is completed between contacts 28*c* and 28*d* by the bridging contact 36*a* as shown in FIG. 10A. Contact 36*b* rests against insulator 24 and no circuit is completed between contacts 28*a* and 28*b*.

Figure 10B:
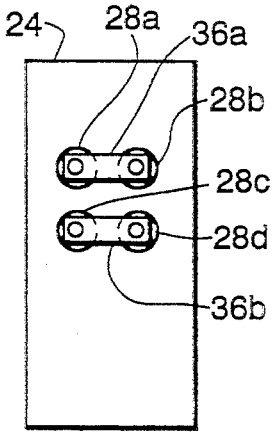

When knob 21 (FIG. 1) is pulled upwardly the contacts 36*a* and 36*b* move upwardly so that contact 36*a* bridges contacts 28*a* and 28*b* while contact 36*b* bridges contacts 28*c* and 28*d* as shown in FIG. 10B. This defines the "actuated" or "on" position of the switch.

Preferably, the size of fixed contacts 28*a*–28*d*, and the vertical spacing between contacts 28*a* and 28*b* relative to the spacing between contacts 36*a* and 36*b* are chosen to provide "make before break" operation. That is, if the switch is in the actuated position shown in FIG. 10B, the contact 36*a* bridges contacts 28*c*–28*d* before the contact 36*b* breaks contact with either contact 28*c*–28*d*.

From the neutral position the switch may be moved to an "off" position by pressing knob 21. The contacts 36*a* and 36*b* move to the position shown in FIG. 10C. In this position the contacts 36*a*, 36*b* do not complete a circuit between contacts 28*a* and 28*b* or between contacts 28*c* and 28*d*.

Slide block 34 is supported within a generally C-shaped support 40 having parallel top and bottom legs 40*a*, 40*b* which extend horizontally as viewed in FIG. 2, and are joined together by a vertically extending leg 40*c*. Support 40 is movable upwardly or downwardly from the position shown in FIGS. 1 and 2 as subsequently explained. The leg 40*c* is provided with a plurality of outwardly extending protrusions 40*d* to reduce friction between support 40 and the surface 12*b* of the housing as the support is moved.

The contact slide block 34 has a projection 34*a* extending outwardly from the surface opposite the surface on which the contacts 36*a*, 36*b* are mounted. The projection serves to center and hold one end of a compression spring 42. Support leg 40*c* is shaped to have an inwardly extending protrusion 40*e* which serves to center the other end of spring 42.

The switch support 40 is movably supported between two movable U-shaped members 44 and 46. Member 44 is provided with an opening 48 surrounded by an upwardly extending projection 50. A switch actuator shaft 52 extends through hole 48. The projection 50 centers a compression spring 54 which is compressed between member 44 and the lower surface of casing 14. Two projections or stops 55 formed on the interior of contact housing 12 limit downward movement of member 44.

Member 46 has an opening 56 surrounded by a downwardly extending projection 58 which serves to center one end of a compression spring 60. A centering element 62 is mounted on the bottom of housing 12 and centers the other end of spring 60 which is compressed between housing 12 and member 46. Two projections or stops 64 formed on the interior of housing 12 limit upward movement of member 46. The stops 55 and 64 may be formed by punching the sides of the housing 12 to deform it inwardly.

As viewed in FIG. 1, the vertical distance between stops 55 and 64 is slightly less than the height of the contact support 40 so that the support is firmly held between members 44 and 46. The support 40 is driven by the switch actuator shaft 52. The shaft is provided with opposing grooves 52*a* near its lower end, one of the grooves being visible in FIG. 2. The top leg 40*a* of the support 40 is provided with a slot 66 having a width greater than the distance between the grooves but less than the diameter of shaft 52. Slot 66 joins an opening 68 in vertical leg 40*c*, the opening being wider than the diameter of shaft 52. Thus, the support 40 may be mounted on, or interlocked with the shaft 52 by aligning opening 68 with shaft 52 as shown in FIG. 1 while at the same time aligning grooves 52*a* with slot 66, and then sliding the top leg 40*a* of the support into the grooves.

The casing 14 has a downwardly extending portion 14*a* which is press fit into an opening in the top of contact housing 12. An axially extending hole 70 is provided in casing portion 14*a* for slidably receiving the shaft 52. A circular opening 72 extends from the top of casing 14 to the hole 70. The opening is slightly larger toward the bottom of the casing than it is near the top so that a circular abutment 74 is formed on the interior surface cf casing 14.

Above the abutment 74 the opening 72 has a diameter slightly greater than the diameter of the slide element 16. The slide element 16 carries a latch or interlock element 76 which extends laterally from the slide and the diameter of opening 72 below abutment 74 is sufficiently large so that the interlock element will not slide on the interior surface of casing 14 below the abutment when the slide and interlock element are moved axially.

Referring now to FIGS. 5–9, the slide element 16 comprises a generally cylindrical body having opposing flats or flat surfaces 78, 79 (FIGS. 6 & 7) extending partially along two sides. The upper portion of the body is provided with external threads 82 so that the internally threaded knob 21 (FIG. 1) may be mounted thereon. A circular hole 84 extends from the top of the slide 16 downwardly to a surface 86. A rectangular slot 88 extends downwardly from surface 86 to a slot 90 which extends horizontally through the slide.

As shown in FIG. 5, the interlock release stem 18 extends into the top of slide element 16 and through hole 84 and slot 88. The stem 18 is an elongated, generally flat element that is wider (FIG. 2) than it is thick (FIG. 1). The stem has an upper portion 18*a* which is serrated on opposing sides, the serrations serving to hold the interlock release push-button 19 (FIG. 1). The stem has a middle portion 18*b*, the width of which is slightly less than the diameter of hole 84 and a lower portion 18*c* having dimensions slightly less than those of the slot 88 so that the stem may slide axially relative to the slide element 16 within hole 84 and slot 88.

The width of stem portion 18*b* is greater than the width of stem portion 18*c* so that abutments 94 are formed on opposite sides of the stem where the two portions meet. A stem return spring 96 surrounds the stem portion 18*c* and rests on surface 86. The abutments 94 compress the spring when a downward force is applied to the pushbutton 19 to move it to the position shown in FIG. 5, and when the force is released the spring returns the stem and pushbutton to the rest position illustrated in FIG. 1.

A notch 98 is cut into one side of the lower portion of stem 18. The notch is bounded by a generally horizontal surface 100 and a cam surface 102 extending upwardly at an angle with respect to surface 100. The cam surface 102 draws the interlock element 76 within the periphery of slide 16 when stem 18 is pressed downwardly. The stem 18 extends through an opening 104 in the interlock element. A compression spring 106 (FIGS. 8 and 9) is disposed between a projection 76*a* on the interlock element and an abutment 108 on a side wall of slot 90 so that the spring tends to move the interlock element to the right as viewed in FIGS. 5, 8 and 9. This rightward movement is limited by engagement of an end wall 110 of the opening 104 with the stem 18.

FIG. 9 is a sectional view taken along the line 8—8 of FIG. 5 but showing the position of the interlock element 76 when no downward pressure is applied to latch stem 18. Spring 106 has moved interlock element 76 to the right so that the end wall 110 is pressing against stem 18 within notch 98. Interlock element 76 extends outwardly beyond the periphery of slide 16. In FIG. 2, the outwardly extended interlock element will engage the abutment 74 if the operator should pull upwardly on the knob 21.

When the button 19 is depressed to move stem 18 downwardly, the cam surface 102 acts against end wall 110 and moves interlock element 76 to the left. A protrusion 76*b* on the interlock element serves to reduce sliding friction between the interlock element and the side wall of slot 90. As the stem moves downwardly the interlock element rides up cam surface 102 and onto the side wall of lower stem portion 18*c*. This is the position of the stem 18 shown in FIG. 5. When the end wall 110 is pressed against the side wall of stem 18, the interlock element 76 is positioned as shown in FIG. 8. The interlock element does not extend beyond the periphery of slide 16. In FIG. 2 when the interlock element 76 is in this position it will clear the abutment 74 so that the slide 16 may be moved upwardly beyond the position illustrated.

As shown in FIG. 6, the lower portion of slide 16 has a slot 112 which extends from slot 90 to the bottom surface of the slide. The slot 112 is intersected by a horizontal slot 114. The switch actuator shaft 52 has two grooves 116 near its upper end and the projecting surfaces 118 of the interlock slide 16 extend into the grooves as the end portion of the shaft 52 is moved horizontally into the slot 114. The slots 112 and 114 extend into the slide 16 from its periphery sufficiently far to permit the shaft 52 and the slide to be aligned coaxially.

The switch is assembled as follows. The casing 14 is press fit into the top of contact housing 12. The U-shaped members are inserted into the contact housing with member 44 above stops 55 and member 46 below stops 64. Spring 54 is positioned between member 44 and the upper interior surface of contact housing 12 and spring 60 is installed between member 46 and the lower interior surface of the housing.

The spring 106 is inserted into slide 16 through the enlarged portion 90*a* of slot 90 (FIG. 7) after which the interlock element 76 is inserted into the slot. The stem 18, with stem return spring 96 thereon, is inserted into the hole 84 in the slide with the stem aligned with slide slot 88 and notch 98 facing in the direction opposite to the direction in which the interlock element 76 extends from the slide. The protruding interlock element is then pushed into the slide until the slot 104 in the interlock element is aligned with stem 18. The stem is inserted through slot 104 so that the notch surface 100 is at least below the lower surface of the interlock element. The force used to align the slot 104 is then removed. As downward force on the stem is released, the spring 96 moves the stem upwardly until surface 100 engages interlock element 76.

Next, the upper end of switch actuator shaft 52 is inserted into slots 112, 114 in the slide 16. The slide and actuator shaft assembly is then inserted into the opening 72 in casing 14 and the actuator shaft 52 aligned with hole 70. The lower end of the actuator shaft will pass through the upper portion of switch housing 12 and move into the upper portion of spring 54 before the interlock element 76 strikes the upper surface of the casing 14. The slide may be further inserted into opening 72 by pressing interlock element 76 into slide 16 while pushing the slide into the opening. The slide is slid into hole 72 until the grooves 52*a* on the lower portion of actuator shaft 52 are below the upper member 44.

The switch support 40 is then inserted into switch housing 12 with the slot 66 in the support aligned with the grooves 52*a* on the actuator shaft. The members 44, 46 will have to be spread apart slightly to permit the support 40 to slide between them.

Spring 42 is mounted on the projection 34*a* and the switch block 34 with the bridging contacts 36*a*, 36*b* thereon is inserted into support 40. Insulator 24 is then pressed onto housing 12, the spring 42 being compressed as the insulator is moved into position on ledge 22. The cover 20 is placed over the insulator with the contacts 28a-28*d* on the cover aligned with the holes 26 in the insulator 24. Finally, the tangs 12*a* on the housing 12 are bent over to clamp the cover to the housing.

As shown in FIG. 1, the switch 10 may be mounted on a control panel 120. The upper portion of casing 14 is provided with external threads 14*b* for receiving a hexagonal nut 122. The nut 122 and a lock washer 124 are mounted on casing 14 and the switch inserted through a hole in control panel 120. A thumb nut 126 is then screwed onto threads 14*b*. Hexagonal nut 122 may then be adjusted to clamp the panel 120.

After the switch is mounted on the control panel the knob 21 is screwed onto the slide 16 and the plastic pushbutton 19 is pressed onto the stem 18.

The switch operates as follows. When no force is applied to knob 21 or pushbutton 19 the compression spring 60 applies a force to member 46 tending to move member 46 and support 40 upwardly. Since shaft 52 is coupled to support 40, shaft 52 is moved upwardly thereby moving the slide 16 upwardly until interlock element 76 engages abutment 74 on the casing. The abutment limits the upward movement of the slide in response to the force exerted by spring 60. The switch assumes the neutral position (FIG. 2) with the switch contacts positioned as shown in FIG. 10A.

If an attempt is made to pull knob 21 upwardly without depressing pushbutton 19, the engagement of interlock element 76 with abutment 74 prevents any movement of slide 16 and the contacts. However, if the pushbutton 19 is pressed downwardly at the same time knob 21 is pulled upwardly the switch may be moved to its actuated position. Depression of the pushbutton moves stem 18 downwardly and cam surface 102 forces interlock element 76 inside the periphery of slide 16 so that it clears abutment 74. The upward force on the knob 21 is transmitted through slide 16 and shaft 52 to the contact support 40 so that the movable contacts move to the position shown in FIG. 10B. The upturned legs of U-shaped element engage the inside top surface of housing 12 to limit the upward movement of the slide and the movable contacts.

Upward movement of contact support 40 causes member 44 to compress spring 54. Upward movement of member 46 is limited by the stops 64.

The downward force on pushbutton 19 may be released any time after the interlock element 76 clears abutment 74. When the pushbutton is released, spring 96 raises the stem 18 relative to slide 16 until the notch surface 100 engages interlock element 76. The spring 106 urges the interlock element outwardly and it slides on interior surface of casing 14.

When the upward force on knob 21 is terminated, the force stored in spring 54 acts to move member 44, support 40, shaft 52 and latch side 16 downwardly until the neutral position is again reached. The stops 55 limit downward movement of member 44 in response to the force exerted by spring 54. Just prior to the time that member 44 reaches stops 55, the interlock element 76 passes abutment 74 and spring 106 urges the interlock element outwardly so that it may engage the abutment upon an upward movement of the slide 16.

The switch is moved from the neutral to the off position by applying a downward force to knob 21. The pushbutton 19 does not have to be operated. The downward force on the knob is transmitted through slide 16 and shaft 52 to the switch support 40 to move the switch contacts to the position shown in FIG. 10C. The downward movement of the slide 16 and the contacts is limited by engagement of the legs of U-shaped element 46 with the bottom wall of housing 12.

As support 40 moves downwardly it acts through member 46 to compress spring 60. Stops 55 prevent member 44 from following support 40. When the downward force on knob 21 is terminated, the force of spring 60 returns the switch to the neutral position with interlock element 76 pressed against abutment 74.

Figure 11:
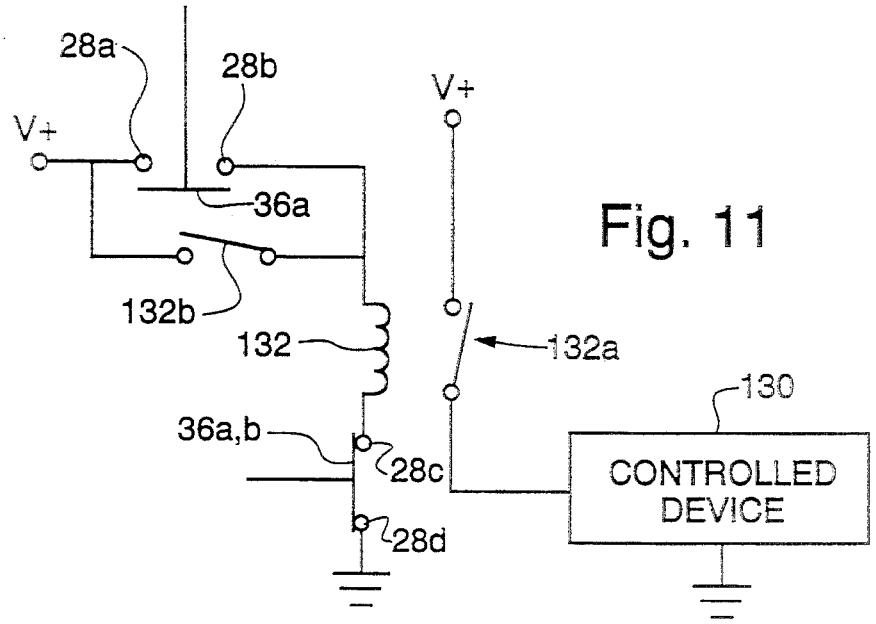
FIG. 11 is a circuit diagram illustrating a typical use of the switch.

FIG. 11 is a simplified circuit diagram illustrating use of the switch to turn a controlled device 130 on or off. The controlled device may be, for example, a power take-off system of a tractor. The device 130 is controlled by a relay 132 having a first set of contacts 132*a* and a second set of contacts 132*b*. Contacts 132*a* are connected between a voltage source and the device 130 while contacts 132b are connected between the coil of relay 130 and a voltage source. The coil of the relay is connected across the voltage in a series circuit which includes the switch contacts 28*a*, 28*b*, 28*c* and 28*d*.

FIG. 11 illustrates the circuit with the switch in the neutral position so that contacts 28*b*, 28C are bridged by contact 36*a*. When the switch is actuated by depressing pushbutton 19 and pulling upwardly on knob 21, the contacts 36*a* and 36*b* move upwardly so that contact 36*a* bridges contacts 28*a* and 28*b* while contact 36*b* bridges contacts 28*c* and 28*d* (FIG. 10B). This completes a circuit from the voltage source to ground through the coil of relay 132.

When the relay is energized, the contacts 132*a* close to apply voltage to the controlled device 130 and contacts 132*b* close to establish a holding circuit through the relay to keep it energized.

When the upward force on the knob 21 is released, the switch returns to the neutral position so that contact 36*a* again bridges contacts 28*c* and 28*d* and contacts 28*a* and 28*b* are open. However, the holding circuit through relay contacts 132*b* keeps relay 132 energized and the controlled device 130 remains energized through relay contacts 132*a*.

Figure 10C:
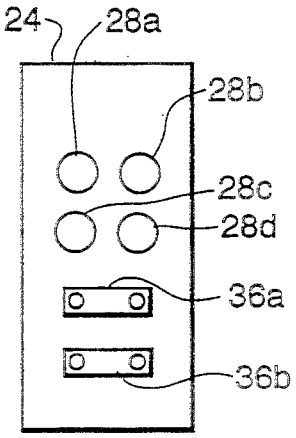

In order to stop the controlled device 130, the switch knob 21 is depressed to move the switch contacts to the off position (FIG. 10C). This opens the circuit between switch contacts 28*c* and 28*d* and relay 132 drops out. Contacts 132*a* open to remove the voltage source from the controlled device.

In the event power should be lost and then restored, the switch prevents the relay 132 from being energized again. When the power is lost the relay drops out and contacts 132*b* open. Since the energizing circuit for the relay is open between switch contacts 28*a* and 28*b*, the relay cannot be energized again without moving switch knob 21 to the actuating position.

Figure 12:
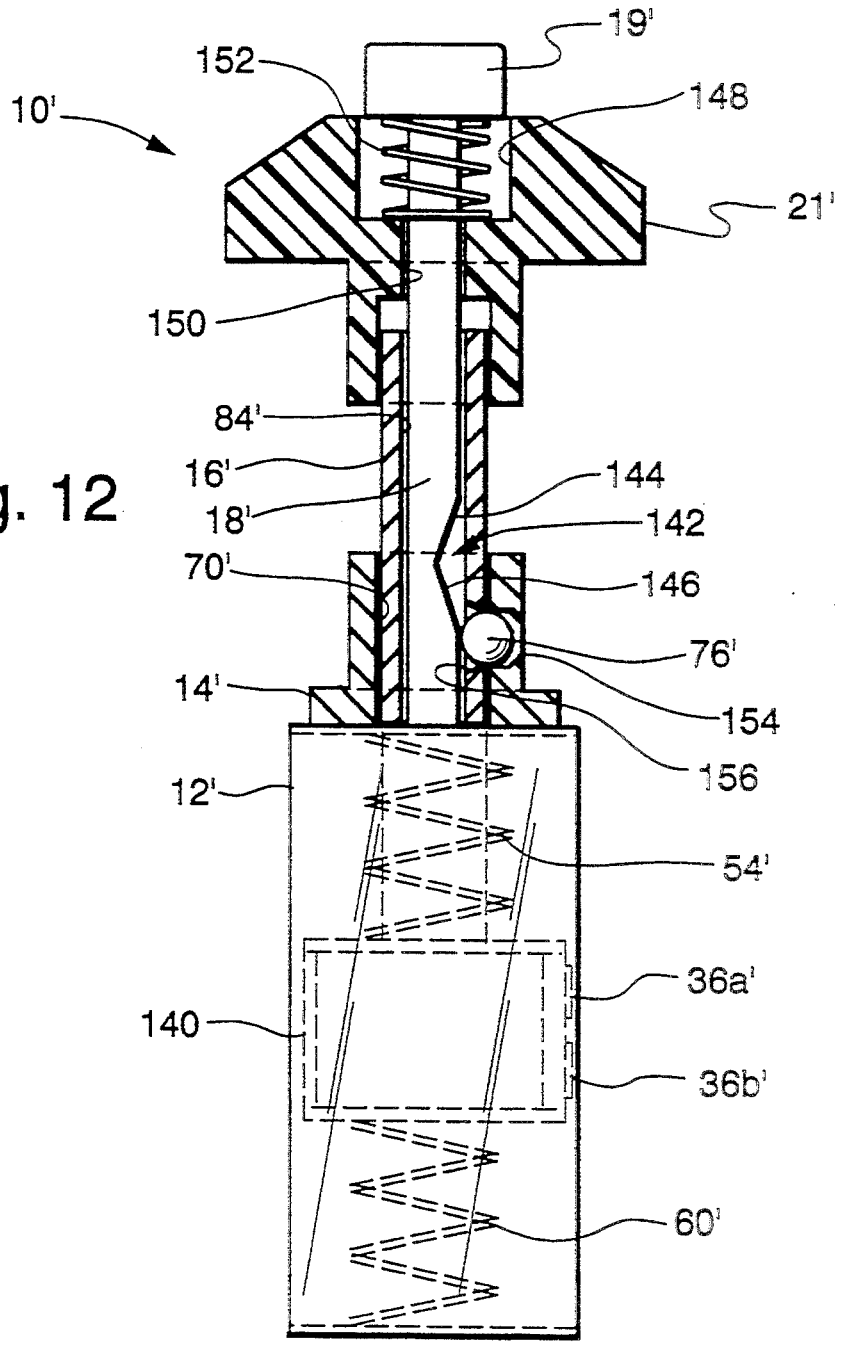
FIG. 12 illustrates a second embodiment of the switch wherein the interlock element comprises a ball.

FIG. 12 illustrates a second embodiment of the invention wherein the interlock element 76' comprises a spherical element such as a ball bearing. The switch includes a contact housing 12', a casing 14' press fit into an opening in the top of the housing, a slide element 16' and an interlock operating stem 18'.

A switch contact support 140 is disposed within housing 12'. Two compression springs 54' and 60' are positioned between the support 140 and the interior top and bottom surfaces, respectively, of housing 12'. Two bridging contacts 36*a'* and 36*b'* are carried by support 140 and cooperate with fixed contacts which are not shown in FIG. 12 but may be arranged like the contacts 28*a*–28*d* shown in FIG. 10C.

The interlock operating stem 18' is generally cylindrical in shape but is provided with a V-shaped recess or groove 142 formed by intersecting flat sloping surfaces 144 and 146.

The casing 14' is provided with a circular opening 70' for slidably receiving the interlock slide 16'. The lower end of interlock slide 16' is attached to the switch contact support 140. Slide 16' is generally tubular in shape with an axially extending central opening 84' for slidably receiving stem 18'. A push-pull knob 21' is attached to the upper end of slide 16' in any suitable manner. Knob 21' has a centrally located recess 148 and a communicating hole 150 extending from the bottom of the recess to the bottom of the knob. The stem 18' extends through hole 150 and into recess 148. A pushbutton 19' is attached to the upper end of stem 18' and a compression spring 152 is compressed between the pushbutton and the bottom bounding surface of recess 148.

Casing 14' is provided with a hole or recess 154 which is slightly smaller than the diameter of interlock element 76'. An opening 156 extends through the wall of interlock slide 16' from the axially extending opening 84' in the slide to the outer circumferential surface of the slide. The opening 156 has a sloping peripheral wall so that it is larger at the interior of the slide than it is at the outer circumferential surface of the slide. The diameter of interlock element 76' and the slope of surface 146 are chosen such that when the interlock element is seated in opening 156 and hole 154 as shown in FIG. 12, the interlock element will engage the sloping surface 146 on the interlock operating stem 18'. Furthermore, the diameter of interlock element is chosen such that when the outer surface of the element concurrently touches both of the intersecting flat surfaces 144, 146 the element is completely within the outer circumferential surface of the slide 16' but is not completely within the hole 84'. This insures that the locking element may be moved completely within the outer periphery of slide 16' but still retained at least partially within opening 156.

Switch 10', like switch 10, has a neutral position, an actuated position and an off position, the movable contacts being positioned relative to the fixed contacts as shown in FIGS. 10A, 10B and 10C, respectively, for the three positions. FIG. 12 illustrates switch 10' in the neutral or non-actuated position. Compression spring 152, acting upwardly on pushbutton 19', urges stem 18' upwardly so that surface 146 urges locking element 76' outwardly through hole 156 until it is fully seated in the hole. The locking element is thus positioned within hole 156 with the center of the locking element being located slightly inside the outer circumferential surface of slide 16'. Spring 60', acting through contact support 140 urges slide 16' upwardly. The upward movement of the slide is limited by engagement of the slide with the interlock element 76' which in turn engages the abutment or portion of casing 14' surrounding hole 154.

Switch 10' cannot be moved from the neutral position to the actuated position without concurrently depressing pushbutton 19' and pulling upwardly on knob 21'. If knob 21' is pulled upwardly without depressing the pushbutton, the interlock element 76', being forced outwardly beyond the periphery of slide 16' by the stem 18' so that it engages casing 14', prevents upward movement of the slide and the contact support 140.

When pushbutton 19' is depressed to move stem 18' downwardly within slide 16', the interlock element 76' falls out of hole 156 because of the inwardly sloping wall of the hole. As the stem 18' moves downwardly the interlock element 76' follows the sloping surface 146 and moves into groove 142. When the interlock element has moved into grove 142 far enough for the interlock element to be fully inside the outer circumferential surface of slide 16', the slide may be moved upwardly by pulling upwardly on knob 21'. As slide 16' moves upwardly, it moves contact support 140 upwardly against the force of spring 54'. A mechanical stop (not shown) is provided for limiting the upward movement of the switch contact support 140. When the support engages the stop, the movable contacts **36*a'* and 36*b'* occupy the position shown in FIG. 10 relative to the fixed contacts 28*a*–28*d*. When the pulling force on knob 21 is released, the compression spring 54' returns the slide 16' and contact support 140 to the position shown in FIG. 12. When the force on pushbutton 19' is released, spring 152 acts against the pushbutton to raise stem 18' within the slide so that sloping surface 146 again forces the locking element outwardly through hole 156**.

The switch 10' may be moved to the off position by pressing downwardly on knob 21'. The pushbutton 19' does not have to be pressed. The downward force on the knob moves slide 16' downwardly. As the knob moves downwardly the pushbutton 19' and stem 18' also move downwardly. The locking element rolls out of hole 156 as the stem 18' is lowered and rides along sloping surface 146 into groove 142 as the stem is lowered still further. The stem may move downwardly until the contact support 140 engages a stop element (not shown) at which time the movable contacts **36*a'*, 36*b'* are positioned relative to fixed contacts 28*a*–28*d* as illustrated in FIG. 10C**.

When the downward force on the knob 21' is released, the spring 60' (now compressed) expands to move slide 16' and the knob back to the neutral position. As the knob moves upwardly it transmits a force through spring 152 to the pushbutton so that the stem 18' moves upwardly, and as the stem moves upwardly the sloping surface 146 on the stem moves the locking element 76' back into the opening 156.

From the foregoing description it is seen that the present invention provides a momentary electrical switch having manually operable contact operating means (21, 16, 52, 40 or 21', 16', 140) for moving slidable contacts relative to fixed contacts, and manually operable interlock means (19, 18, 76 or 19', 18', 76') carried by the contact operating means in a first direction except when a manual force is concurrently applied to the interlock means in a second direction. The interlock means includes an interlock element (76 or 76') and an interlock release means (19, 18 or 19', 18') for releasing the interlock element when a manual force is applied in the second direction.

While the invention has been described in specific detail to illustrate the principles of the invention, it will be understood that various modifications and substitutions may be made in the described embodiments without departing from the spirit and scope of the invention as defined by the appended claims.

We claim:

1. A momentary electrical switch comprising:

a switch housing;

first contact means fixed relative to said switch housing;

second contact means slidable relative to said first contact means between a first position and a second position;

a casing mounted on said switch housing;

manually operable contact operating means for moving said second contact means between said first and second positions, said contact operating means being slidably mounted in said casing for movement along an axis in a first or a second direction; and, manually operable interlock means carried by said contact operating means and cooperating with said casing to prevent movement of said contact operating means in said first direction except when forces are concurrently applied to said interlock means in said second direction and said contact operating means in said first direction.

2. A momentary electrical switch as claimed in claim 1 wherein said manually operable contact operating means includes a knob having a central opening therein and said manually operable interlock means includes a pushbutton supported in said central opening.

3. A momentary electrical switch as claimed in claim 2 wherein said contact operating means includes a slide element mounted in said casing for sliding movement relative to said casing, said knob being attached to said slide element; and said interlock means comprises a stem on which said pushbutton is mounted, and an interlock element movable in an opening in said slide element, and a spring means for urging said interlock element radially outwardly from a peripheral surface of said slide element whereby said interlock element may engage said casing when a force is applied to said knob in said first direction, said stem having a cam surface acting against said interlock element to move said interlock element relative to the periphery of said slide element when a manual force is applied to said pushbutton in said second direction.

4. A momentary electrical switch as claimed in claim 3 wherein said spring means comprises a stem return spring for urging said stem in said first direction relative to said slide element.

5. A momentary electrical switch as claimed in claim 3 wherein said contact operating means comprises a support for movably supporting said second contact means, said support being responsive to movement of said slide element for moving said second contact means.

6. A momentary electrical switch as claimed in claim 2 wherein said contact operating means comprises a slide element slidably mounted in said casing and a contact support means operatively connected to move with said slide element, said knob being attached to said slide element.

7. A momentary electrical switch as claimed in claim 6 wherein said interlock means comprises a stem on which said pushbutton is mounted and an interlock element movable between a position within said slide element and a position in which the interlock element extends outwardly from said slide element, said stem having a cam surface thereon for moving said interlock element from one to the other of said positions.

8. In a momentary electrical switch having a housing having therein first contact means fixed relative to said housing and second contact means slidable relative to said first contact means, the improvement comprising:

a casing attached to said housing;

contact operating means slidable in said casing and into said housing along an axis for moving said second contact means, said contact operating means including a knob to which a manual force may be applied to move said contact operating means in a first direction along said axis;

interlock means including an interlock element associated with said contact operating means and selectively engageable with said casing for preventing movement of said contact operating means in said first direction; and, interlock release means for releasing said interlock means so that said contact operating means may move in said first direction when a manual force is applied to said knob in said first direction at the same time a manual force is applied to said interlock release means in a second direction opposite said first direction.

9. A momentary electrical switch as claimed in claim 8 wherein said interlock release means includes a pushbutton extending from an opening in said knob.

10. A momentary electrical switch as claimed in claim 8 and including spring means for urging said contact operating means in said second direction.

11. A momentary electrical switch as claimed in claim 8 wherein said contact operating means comprises a slide element having an opening therein, said interlock element being movable in said opening so as to extend at least partially outwardly of said slide element.

12. A momentary electrical switch as claimed in claim 11 wherein said casing is affixed to said housing, said slide element being mounted to slide along said axis within said casing.

13. A momentary electrical switch as claimed in claim 12 wherein said interlock means includes an abutment within said casing engagable by said interlock element when said interlock element extends partially outwardly of said slide element.

14. A momentary electrical switch as claimed in claim 13 wherein said interlock release means comprises an elongated stem on which a pushbutton is mounted, said stem having a cam surface acting against said interlock element to move said interlock element into said latch slide when said pushbutton is pressed in a second direction opposite to said first direction.

15. A momentary electrical switch as claimed in claim 14 and further comprising a compression spring for urging said stem in said first direction.

16. A momentary electrical switch as claimed in claim 7 having a neutral position, an actuated position to which the second contact means may be moved by applying a manual force to said knob in said first direction while said interlock release means is releasing said interlock means, and an off position to which said second contact means may be moved by applying a manual force to said knob in a second direction opposite to said first direction, said switch further comprising first and second springs for returning said switch to said neutral position when no manual force is applied to said knob.

17. A momentary electrical switch as claimed in claim 16 wherein said first contact means comprises first and second sets of contacts, each set having two contacts, and said second contact means comprises first and second bridging contacts, said first bridging contact electrically connecting the contacts of said first set of contacts when said switch is in said neutral position and electrically connecting the contacts of said second set when said switch is in said actuated position, said second bridging contact electrically connecting the contacts of said first set of contacts when said switch is in said actuated position, said first and second contacts bridging none of the contacts of said first set when said switch is in said off position.

18. A momentary electrical switch as claimed in claim 17 in combination with a relay having a coil and first and second relay contacts, said coil and said first and second sets of contacts being connected in a series circuit across a voltage source, said first relay contacts being connected in parallel with said contacts of said first set between said voltage source and said coil, said second relay contacts being connected in an energizing circuit for a device controlled by said switch.

* * * * *